US008601842B2

(12) United States Patent
Sheldahl et al.

(10) Patent No.: US 8,601,842 B2
(45) Date of Patent: Dec. 10, 2013

(54) LOCK PROTECTION SYSTEM

(75) Inventors: Eric A. Sheldahl, Urbandale, IA (US); William A. Price, Ankeny, IA (US)

(73) Assignee: Lock-It, LLC, Glendale, AZ (US)

( * ) Notice: Subject to any disclaimer, the term of this patent is extended or adjusted under 35 U.S.C. 154(b) by 175 days.

(21) Appl. No.: 12/931,791

(22) Filed: Feb. 10, 2011

(65) Prior Publication Data

US 2012/0204609 A1 Aug. 16, 2012

(51) Int. Cl.
*E05B 15/16* (2006.01)

(52) U.S. Cl.
USPC ..... 70/417; 70/56; 70/164

(58) Field of Classification Search
USPC ..... 70/2, 56, 158, 163, 164, 416, 417, 423, 70/424, 426, 428, 439, 455
See application file for complete search history.

(56) References Cited

U.S. PATENT DOCUMENTS

| | | | | |
|---|---|---|---|---|
| 4,191,034 | A * | 3/1980 | Froess et al. | 70/258 |
| 4,370,873 | A * | 2/1983 | Edmunds | 70/163 |
| 4,406,358 | A * | 9/1983 | Zahradnik | 70/164 |
| 4,873,851 | A * | 10/1989 | Arnett | 70/259 |
| 6,367,292 | B1 * | 4/2002 | Bunger | 70/56 |
| 6,578,398 | B2 * | 6/2003 | Behunin | 70/417 |
| 6,755,053 | B1 * | 6/2004 | Dias | 70/14 |
| 6,953,149 | B2 * | 10/2005 | Taylor | 70/417 |
| 7,210,316 | B1 * | 5/2007 | Falconer et al. | 70/2 |

* cited by examiner

*Primary Examiner* — Christopher Boswell
(74) *Attorney, Agent, or Firm* — Brett J. Trout

(57) ABSTRACT

A system for preventing vandalism and unauthorized access to a lock. The system has a male lock member slidably engaged to a female lock member. The lock members are provided in an enclosure and engaged to the sidewalls thereof. A padlock is provided around a charging bar on the member male lock member to prevent the male lock member from sliding relative to the female lock member a sufficient distance to allow the male lock member and female lock member to disengage from the sidewalls of the enclosure. Engaging the male lock member and female lock member to the sidewalls in front of a lock prevents direct access to the lock, thereby reducing vandalism and unauthorized access.

20 Claims, 6 Drawing Sheets

LOCK PROTECTION SYSTEM

TECHNICAL FIELD

The disclosed embodiments relate generally to a locking system and, in particular, to a charging bar system preventing access to a lock.

BACKGROUND

Locks are subject to vandalism and unauthorized access. Given the design of prior art locking systems, it has heretofore not been possible to provide a system for quickly, easily and inexpensively retrofitting existing locking systems to prevent vandalism and unauthorized access.

SUMMARY OF THE DISCLOSED SUBJECT MATTER

The present invention provides systems and methods for preventing access to a lock. A male lock member, including a bar and a stop is slidably coupled to a female lock member defining a slot sized to receive the bar. When secured to the sidewalls of a housing provided around a lock, the male lock member and female lock member create a charging bar system that prevents vandalism and unauthorized access to the lock. A shackle coupled to a padlock is provided around the bar to prevent movement of the bar further into the slot of the female lock member and removal of the male lock member and female lock member from the sidewalls of the housing.

BRIEF DESCRIPTION OF THE DRAWINGS

The present invention will now be described, by way of example, with reference to the accompanying drawings in which.

DETAILED DESCRIPTION OF THE DRAWINGS

Figure 2:
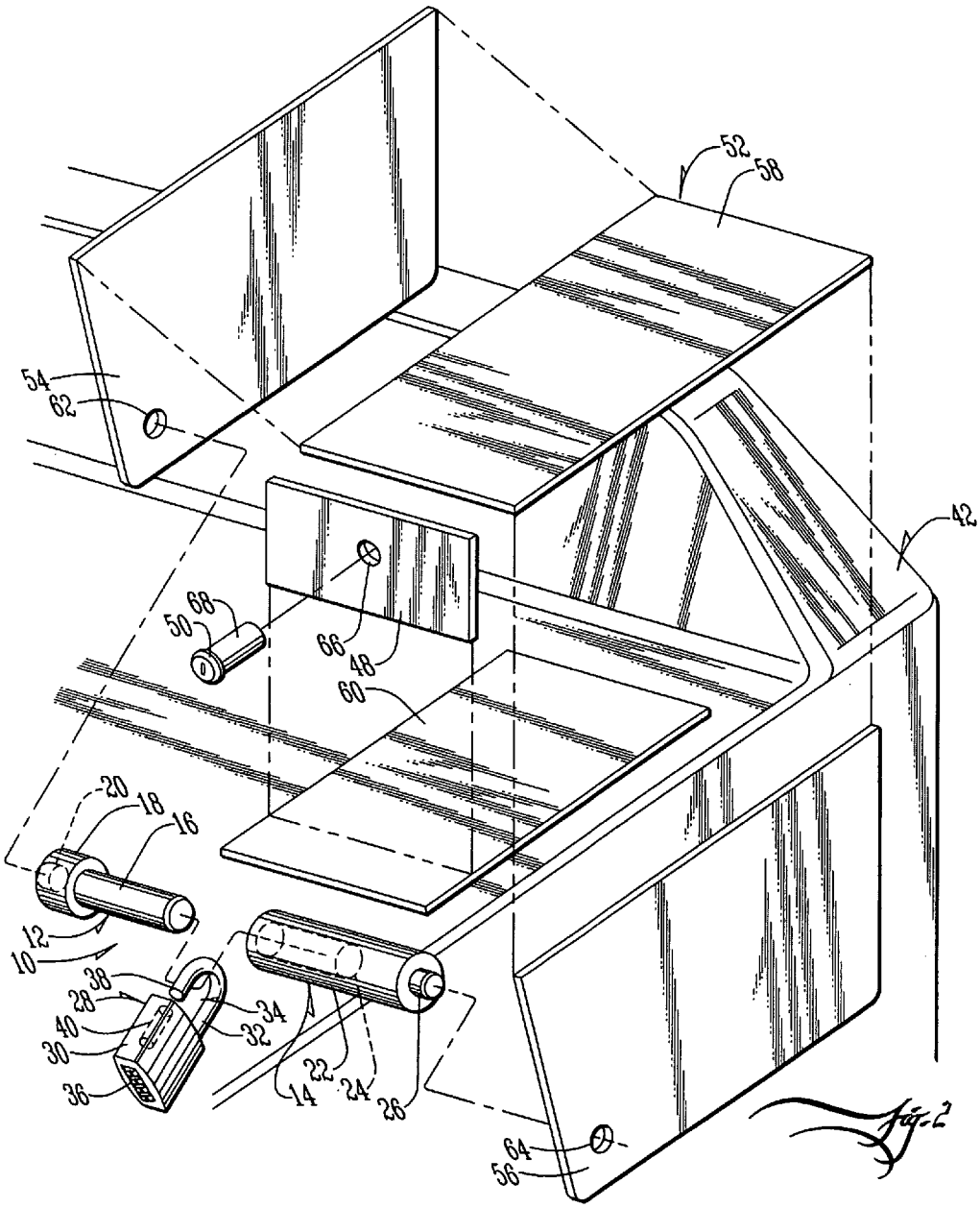
FIG. 2 is an exploded perspective view in partial phantom of the male locking member, female locking member, padlock and enclosure of the charging bar locking system of FIG. 1.

A charging bar locking system (10) is provided with a male lock member (12) slidably coupled to a female lock member (14). As shown in FIG. 2, the male lock member (12) is provided with a cylindrical bar, such as a charging bar (16), around which is secured a cylindrical stop (18), and a cylindrical first wall engager (20). The charging bar (16), stop (18) and wall engager (20) are integrally formed from a single piece of hardened, stainless steel, but may be constructed from separate components and of any suitable material or dimensions.

The female lock member (14) is provided with a cylindrical sleeve (22) defining a cylindrical interior slot (24) and a cylindrical wall engager (26). While the slot (24) may be of any suitable dimensions, the slot (24) is preferably slightly larger than the charging bar (16) and has a depth preferably between forty percent and two hundred percent the length of the charging bar (16), more preferably between fifty percent and one hundred fifty percent the length of the charging bar (16), and most preferably between eighty percent and one hundred twenty percent the length of the charging bar (16).

The system (10) is also provided with a lock, such as a padlock (28), having a lock body (30) and a shackle (32) defining an interior (34). The padlock (28) may be of any suitable type known in the art. It may be key actuated or provided with a tumbler assembly (36) to release the free end (38) of the shackle (32) from the slot (40) of the body (30) of the padlock (28).

Figure 5:
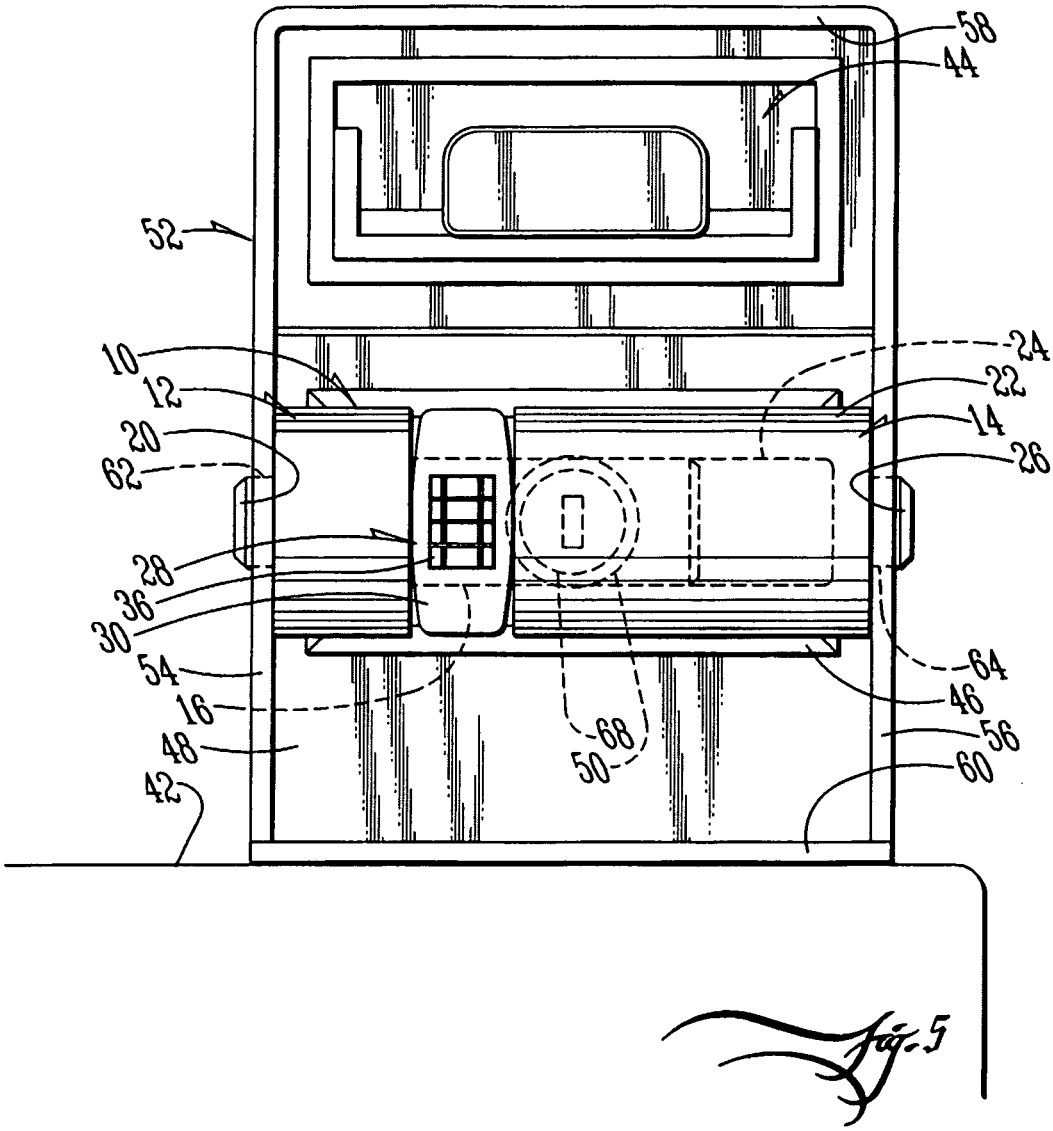
FIG. 5 is a front elevation in partial phantom of the charging bar locking system of FIG. 1, shown with the male member and female member engaging the sidewalls of the enclosure and provided with the shackle of the padlock provided around the charging bar.

The interior (34) of the shackle (32), is small enough that the stop (18) and the female lock member (14) are too large to fit within the interior (34) when the padlock (28) is locked around the charging bar (16). The charging bar (16) is preferably provided with a diameter slightly smaller than the interior (34) of the shackle (32), such that when the shackle (32) is engaged within the slot (40) of the padlock (28) around the charging bar (16), the padlock (28) is free to spin relative to the charging bar (16), but the padlock (28) cannot be moved into a position sufficient to remove the male locking member (12) and female locking member (14) from the enclosure described more fully below. (FIGS. 2 and 5). The interior (34) of the shackle (32) is provided with a smallest diameter preferably between one-tenth of one percent and twenty percent of the diameter of the charging bar (16), more preferably between one percent and ten percent of the diameter of the charging bar (16) and most preferably between one percent and four percent of the diameter of the charging bar (16). The stop (18) and sleeve (22) are preferably provided with diameters sized to engage at least a portion of the body (30) of the padlock (28) when the shackle (32) is engaged in the slot (40) of the padlock (28) around the charging bar (16). Alternatively, the diameter of the stop (18) and sleeve (22) may be small enough to engage the shackle (32) without engaging the body (30). It is desirable, however, to provide the stop (18) and sleeve (22) with the extra diameter to engage at least a portion of the body (30) of the padlock (28) when the shackle (32) is engaged in the slot (40) of the padlock (28) around the charging bar (16) to increase the strength thereof and resistance to vandalism and unauthorized removal. Alternatively, the stop (18) and sleeve (22) may be provided with a larger diameter to engage a larger portion of the body (30) of the padlock (28), and may even be provided with a diameter sufficient to cover the entire body (30) of the padlock (28).

In the preferred embodiment, however, the stop (18) and sleeve (22) engage a smaller portion of the body (30) of the padlock (28) to reduce the cost, weight and installation issues associated with the system (10). Preferably, the stop (18) and sleeve (22) extend over between one and twenty millimeters of the body (30) of the lock (18), more preferably between two and ten millimeters, and most preferably between three and eight millimeters. Additionally, while it is desirable that the diameter of the stop (18) and sleeve (22) are identical, the diameters of the stop (18) and sleeve (22) may be different.

Figure 1:
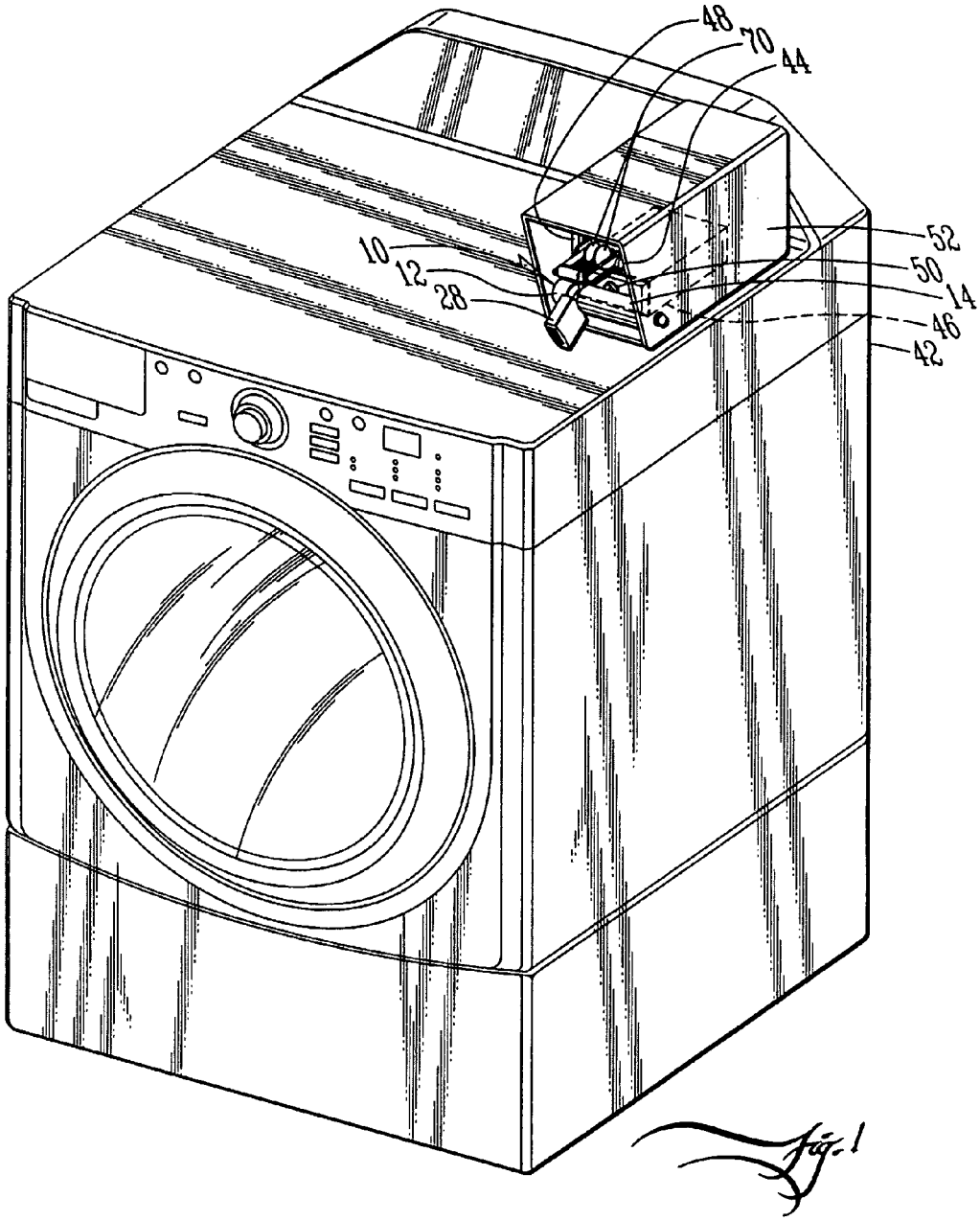
FIG. 1 is a perspective view of the charging bar locking system of the present invention.

As shown in FIG. 1, a machine, such as a washing machine (42) is provided with a coin operation system (44), such as those known in the art. The system (10) may instead be used to secured computers, lockers or any other device or area protected by a lock. The coin operation system (44) feeds into a coin tray (46), provided on a front wall (48) with a lock (50). The lock (50) may be key operated in a manner such as that known in the art.

Figure 3:
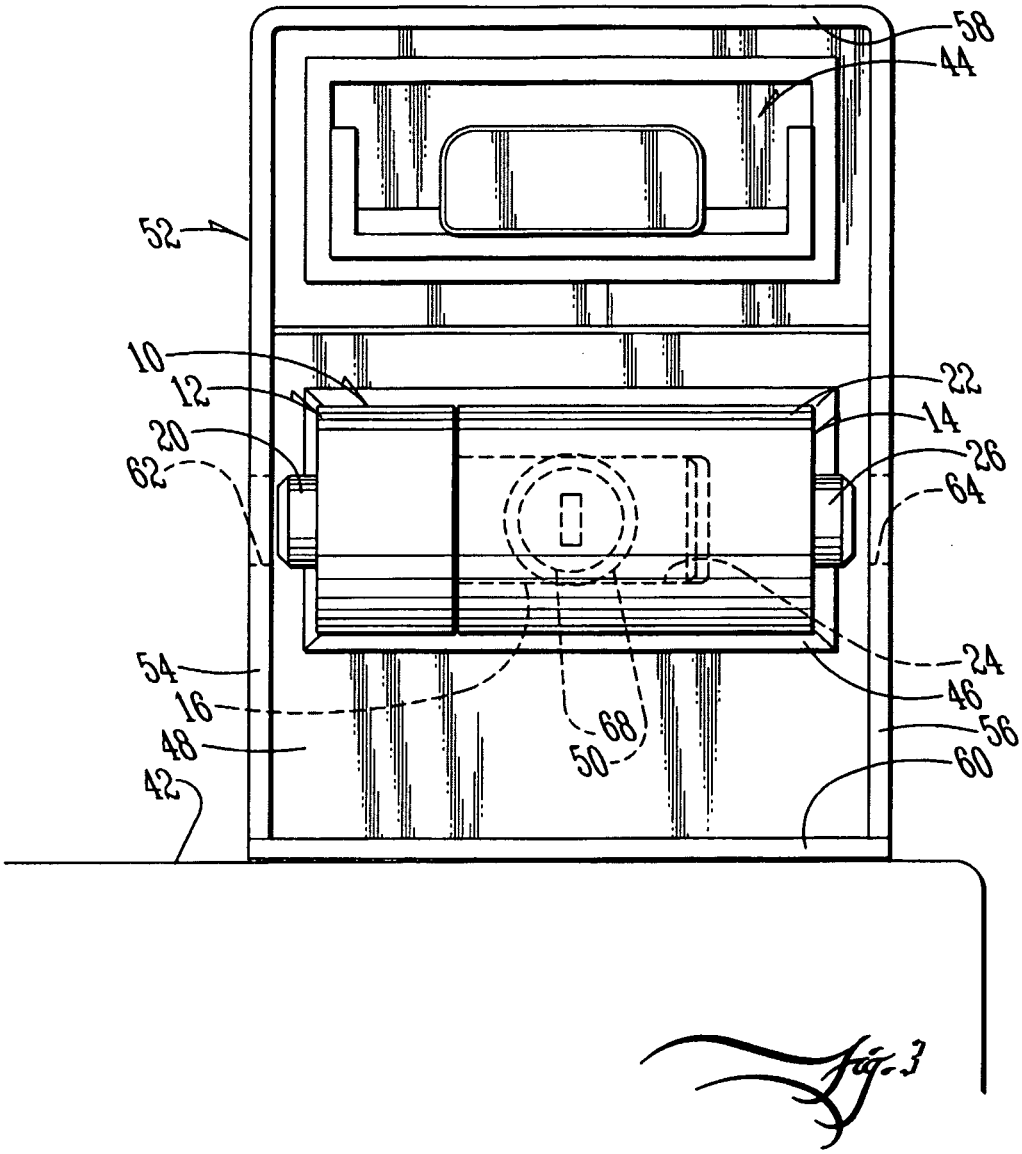
FIG. 3 is a front plan view in partial phantom of the charging bar locking system of FIG. 1, shown with the male member and female member provided within the enclosure.

As shown in FIG. 3, an enclosure (52) surrounds the tray (46) and extends over the front wall (48) on which the lock (50) is located. The enclosure (52) has a first sidewall (54), a second sidewall (56), a ceiling (58) and a floor (60), preferably constructed of 0.5 centimeters thick plate steel, welded together. (FIGS. 2-3). The enclosure (52) may be constructed of any suitable dimensions and material.

As shown in FIG. 2, the first sidewall (54) defines an opening (62) sized to accommodate the wall engager (20). The opening (62) is slightly larger than the wall engager (20) to allow the wall engager (20) to be easily inserted therein and rotated relative thereto. Similarly, the second sidewall (56) defines an opening (64) sized to accommodate the wall engager (26) to allow easy insertion and rotation relative thereto. The openings (62) and (64) are preferably located so as to position the charging bar (16) along a line that intersects a line coaxial with the keyhole (66) into which the tumbler cylinder (68) of the lock (50) is provided.

As shown in FIG. 3, when it is desired to prevent access to the tumbler cylinder (68) of the lock (50) to prevent vandalism and unauthorized access thereto, the male lock member (12) and female lock member (14) are moved into a first position, wherein the charging bar (16) is slid into the slot (24) a sufficient distance to allow the male lock member (12) and female lock member (12) to fit within the enclosure (52). Once inside the enclosure (52), the male lock member (12) and female lock member (12) are moved into a second position, wherein the male lock member (12) is slid outwardly from the female lock member (14) until the wall engager (20) fits into the opening (62) in the first sidewall (54) and the wall engager (26) of the female lock member (14) engages the opening (64) of the second sidewall (56) in a manner such as that shown in FIG. 4.

Figure 4:
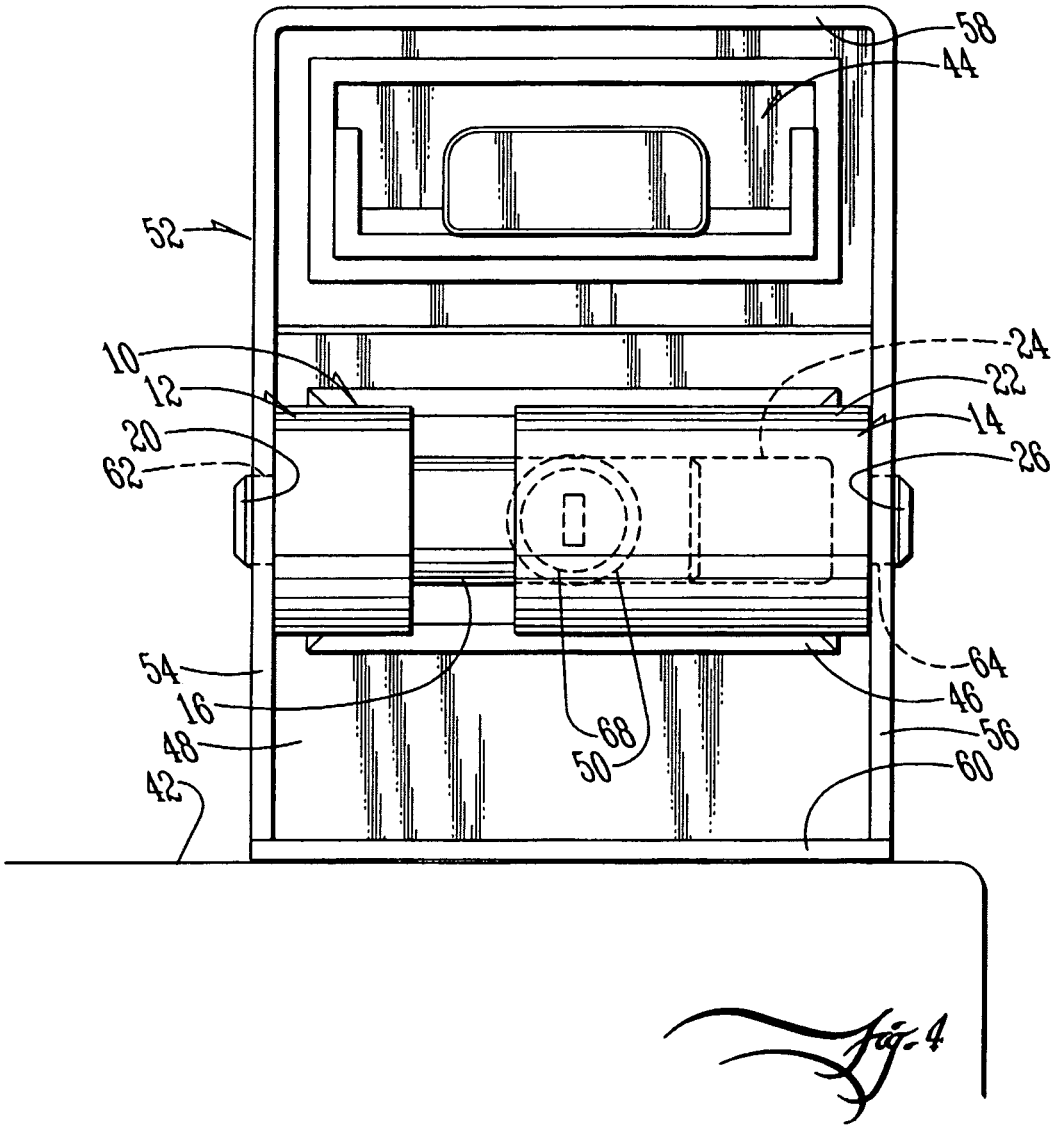
FIG. 4 is a front elevation in partial phantom of the charging bar locking system of FIG. 1, shown with the male member and female member extended to engage the sidewalls of the enclosure.

As shown in FIG. 4, with the wall engagers (20) and (26) engaged with the openings (62) and (64), a majority of the charging bar (16) of the male lock member (12) is still provided within the sleeve (22) of the female lock member (14). To prevent removal of the charging bar locking system (10) from the enclosure (52), the shackle (32) of the padlock (28) is provided around the charging bar (16), and the free end (38) of the shackle (32) is secured within the slot (40) of the body (30) of the padlock (28). (FIGS. 2 and 4-5). Locking the shackle (32) around the charging bar (16) provides the body (30) of the padlock (28) between the stop (18) and the sleeve (22) with insufficient clearance to allow the male lock member (12) to move toward the female lock member (14) a sufficient distance to allow the removal of the wall engagers (20) and (26) from the openings (62) and (64).

Preferably, the clearance between the stop (18) and sleeve (22) and the body (30) of the padlock (28) is between one-tenth of a percent and seventy-five percent of the length of the wall engagers (20) and (26), more preferably between one percent and fifty percent the length of the wall engagers (20) and (26), and, most preferably between one percent and twenty-five percent of the length of the wall engagers (20) and (26). At least a small amount of clearance between the stop (18) and sleeve (22) and the body (30) of the padlock (28) is desirable to allow the padlock (28) to rotate relative to the charging bar (16) to allow access to the tumbler assembly (36). The enclosure (52) is sufficiently small and the stop (18), sleeve (22) and padlock (28) sufficiently large to prevent access to the tumbler cylinder (68) of the lock (50) along a line coaxial with the tumbler cylinder (68). While access may still be made to the tumbler cylinder (68) over the top or underneath the stop (18), sleeve (22) and padlock (28), direct access to the tumbler cylinder (68) with a standard screwdriver, pry bar or the like is thwarted while the male lock member (12), female lock member (14) and padlock (28) are in place.

When it is desired to access the tumbler cylinder (68) of the lock (50), the body (30) of the padlock (28) is rotated relative to the charging bar (16) to allow access to the tumbler assembly (36). The tumbler assembly (36) is provided with a predetermined code in a manner such as that known in the art to release the shackle (32) from the slot (40). (FIGS. 2 and 5). The shackle (32) is then released from the charging bar (16) and the padlock (28) is removed from the enclosure (52). The male lock member (12) is then moved toward the female lock member (14), with the charging bar (16) moving into the slot (24) of the sleeve (22) a sufficient distance to allow the wall engager (20) to be removed from the opening (62), so that the male lock member (12) and female lock member (14) may be removed from the enclosure (52). Thereafter, the lock (50) may be accessed with a key (not shown) so that the tray (46) may be slid out of the enclosure (52) and the money (70) contained therein may be removed. (FIGS. 1-3). The tray (46) may then be slid back into the enclosure (52), the lock (50) locked and the system (10) reinstalled to prevent undesired vandalism or unauthorized access to the lock (50) and tray (46). As shown, the system (10) not only thwarts access to the lock (50), but thwarts access to an removal of the tray (46) even if the lock is defeated or left open.

Figure 6:
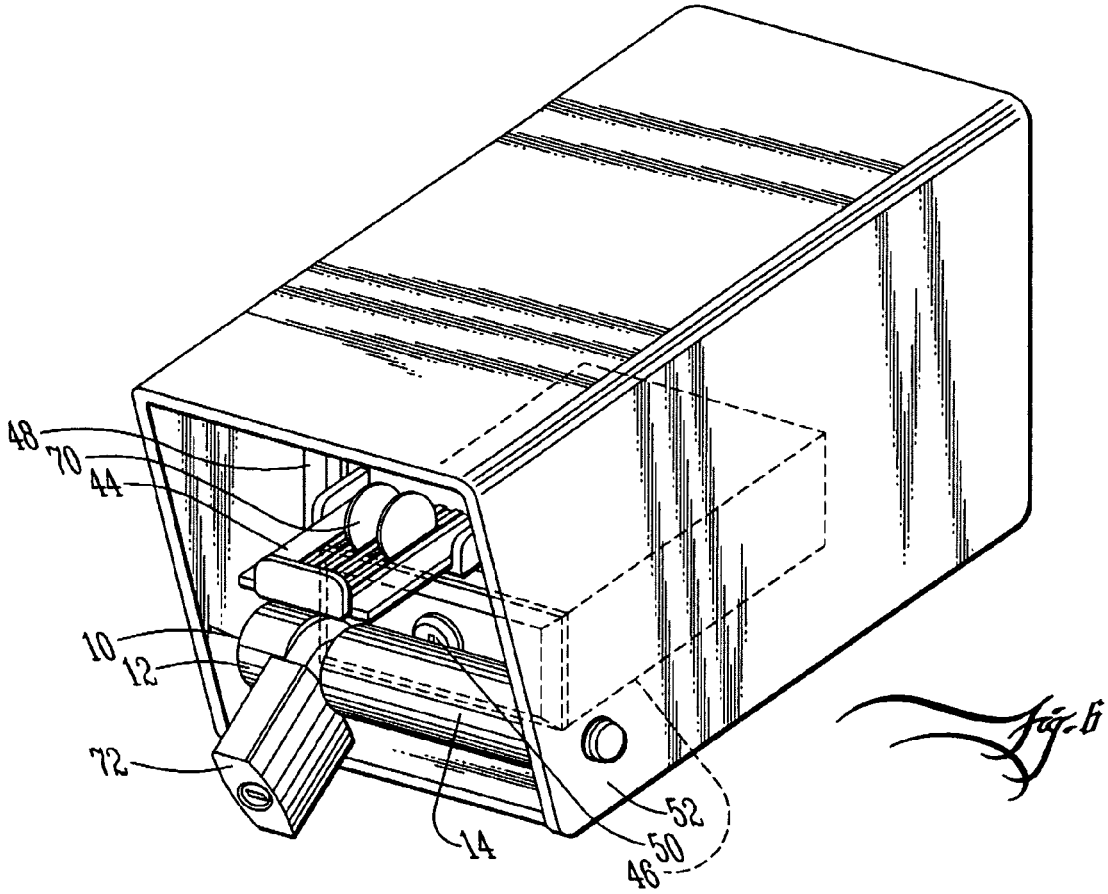
FIG. 6 is a perspective view of an alternative embodiment of the charging bar locking system.

As shown in FIG. 6, the padlock may be a key actuated padlock (72) or any other suitable type lock known in the art.

Although the invention has been described with respect to a preferred embodiment thereof, it is to be understood that it is not to be so limited since changes and modifications can be made therein which are within the full, intended scope of this invention as defined by the appended claims. As an example, the charging bar locking system (10) of the present invention may be used in association with vending machines, doors or any other use where it is desired to prevent vandalism or access to a keyhole or other item. Other alternative embodiments of the present invention involves placing the charging bar locking system (10) in front of a keypad, retinal scanner, magnetic swipe reader, smartcard reader, infrared reader, or any other type of verification system.

What is claimed is:

1. A locking system comprising:

(a) a male lock member comprising:
  (i) a bar;
  (ii) a stop coupled to the bar;

(b) a female lock member defining a slot sized to receive the bar;

(c) a lock comprising:
  (i) a lock body;
  (ii) a shackle coupled to the lock body, wherein the shackle defines an interior;

(d) wherein the stop and the female lock member are too large to fit within the interior;

(e) wherein the bar is provided at least partially within the slot; and (f) wherein the shackle is locked to the lock body, around the bar, in a manner that prevents the bar from extending to the end of the slot.

2. The locking system of claim 1, wherein when the bar system is positioned between a first wall and a second wall, wherein the bar is slidable within the slot between a first position where the bar is engaged with the first wall and the sleeve is engaged with the second wall, and a second position where the bar is engaged with the first wall and the sleeve is not engaged with the second wall, and wherein the shackle is sufficiently wide to prevent movement of the bar system from the first position to the second position.

3. The locking system of claim 1, wherein the stop is cylindrical.

4. The locking system of claim 3, wherein the female lock member is cylindrical.

5. The locking system of claim 4, wherein the bar is cylindrical.

6. The locking system of claim 1, further comprising a first wall engager coupled to the bar and a second wall engager coupled to the female lock member.

7. A charging bar system comprising:

(a) a charging bar;

(b) a sleeve slidably coupled around the charging bar;

(c) wherein the sleeve is provided with a slot configured to receive the charging bar to a predetermined depth;

(d) a stop coupled to the charging bar;

(e) a lock comprising:

(i) a shackle; and (ii) a body;

(f) wherein the shackle is provided around the charging bar, between the sleeve and the stop in a manner that prevents the charging bar from extending to the end of the slot.

8. The charging bar system of claim 7, wherein when the charging bar system is positioned between a first wall and a second wall, wherein the charging bar is slidable within the slot between a first position where the charging bar is engaged with the first wall and the sleeve is engaged with the second wall, and a second position where the charging bar is engaged with the first wall and the sleeve is not engaged with the second wall, and wherein the shackle is sufficiently wide to prevent movement of the charging bar system from the first position to the second position.

9. The charging bar system of claim 8, wherein the stop is cylindrical.

10. The charging bar system of claim 9, wherein the sleeve is cylindrical.

11. The charging bar system of claim 10, wherein the charging bar is cylindrical.

12. The charging bar system of claim 8, further comprising a first wall engager coupled to the charging bar and a second wall engager coupled to the sleeve.

13. The charging bar system of claim 7, further comprising a first wall engager coupled to the charging bar and a second wall engager coupled to the sleeve.

14. The charging bar system of claim 7, further comprising an enclosure comprising:

(a) an enclosure having a back wall, a first sidewall, a second sidewall, a floor and a ceiling; and (b) a lock provided on the back wall.

15. The charging bar system of claim 14, wherein when the charging bar system is positioned between a first wall and a second wall, wherein the charging bar is slidable within the slot between a first position where the charging bar is engaged with the first wall and the sleeve is engaged with the second wall, and a second position where the charging bar is engaged with the first wall and the sleeve is not engaged with the second wall, and wherein the shackle is sufficiently wide to prevent movement of the charging bar system from the first position to the second position.

16. The charging bar system of claim 7, wherein the shackle defines an interior and wherein the stop and the sleeve are too large to fit within the interior.

17. A method of thwarting unauthorized access to a lock, the method comprising:

(a) providing an enclosure having a back wall, a first sidewall, a second sidewall, a floor and a ceiling;

(b) providing a keyhole having access through the enclosure;

(c) providing a charging bar;

(d) coupling a stop to the charging bar;

(e) providing a sleeve defining a slot;

(f) providing the charging bar into the slot;

(g) engaging the charging bar with the first sidewall;

(h) engaging the sleeve with the second sidewall;

(i) providing a lock comprising:

(ii) a shackle;

(ii) a body;

(iii) wherein the lock is of a sufficient configuration to prevent the charging bar from extending to the end of the slot;

(j) providing the shackle around the charging bar;

(k) wherein the shackle defines an interior and wherein the stop and the sleeve are too large to fit within the interior; and (l) locking the shackle around the charging bar.

18. The method of thwarting unauthorized access to a lock of claim 17, wherein the charging bar, when engaged to the first sidewall, intersects a line coaxial with the keyhole.

19. The method of thwarting unauthorized access to a lock of claim 17, wherein the stop is cylindrical.

20. The method of thwarting unauthorized access to a lock of claim 19, wherein the sleeve is cylindrical.

* * * * *